US011649151B2

(12) United States Patent
Clüsserath et al.

(10) Patent No.: US 11,649,151 B2
(45) Date of Patent: May 16, 2023

(54) FILLING ELEMENT, FILLING SYSTEM, AND METHOD FOR FILLING CONTAINERS

(71) Applicant: KHS GmbH, Dortmund (DE)

(72) Inventors: Ludwig Clüsserath, Bad Kreuznach (DE); Dieter-Rudolf Krulitsch, Bad Kreuznach (DE); Andreas Lohner, Wadalgesheim (DE); Bernd Bruch, Weinsheim (DE)

(73) Assignee: KHS GmbH, Dortmund (DE)

( * ) Notice: Subject to any disclaimer, the term of this patent is extended or adjusted under 35 U.S.C. 154(b) by 40 days.

(21) Appl. No.: 17/285,380

(22) PCT Filed: Oct. 7, 2019

(86) PCT No.: PCT/EP2019/077017
§ 371 (c)(1),
(2) Date: Apr. 14, 2021

(87) PCT Pub. No.: WO2020/094307
PCT Pub. Date: May 14, 2020

(65) Prior Publication Data

US 2021/0339997 A1 Nov. 4, 2021

(30) Foreign Application Priority Data

Nov. 6, 2018 (DE) ..... 10 2018 127 592.7

(51) Int. Cl.
*B67C 3/12* (2006.01)
*B67C 3/20* (2006.01)
*B67C 3/28* (2006.01)

(52) U.S. Cl.
CPC ..... *B67C 3/12* (2013.01); *B67C 3/20* (2013.01); *B67C 3/282* (2013.01); *B67C 3/286* (2013.01)

(58) Field of Classification Search
CPC .. B67C 3/12; B67C 3/20; B67C 3/282; B67C 3/286
USPC ..... 141/6
See application file for complete search history.

(56) References Cited

U.S. PATENT DOCUMENTS 4,452,689 A * 6/1984 Russum ..... C10G 1/006 166/266
6,213,169 B1 * 4/2001 Clusserath ..... B67C 3/12 141/54
10,730,734 B2 * 8/2020 Brey ..... B67C 3/262
2005/0241726 A1 * 11/2005 Clusserath ..... B67C 3/04 141/144
2016/0152458 A1 * 6/2016 Clüsserath ..... B67C 3/10 53/510

FOREIGN PATENT DOCUMENTS

DE 3807046 A1 10/1989
DE 60307504 T2 3/2007
(Continued)

OTHER PUBLICATIONS

WO2016207006A1—English Translation (Year: 2016).*
DE102015118612A1—English Translation (Year: 2017).*

*Primary Examiner* — Mary E McManmon
*Assistant Examiner* — Christopher M Afful
(74) *Attorney, Agent, or Firm* — Occhiuti & Rohlicek LLP

(57) ABSTRACT

A filling element has a gas valve that controls flow of gas through a gas channel that extends into or faces the container during filling thereof. The gas valve transitions between discrete states, which includes a fully-open state, a closed state, and one or more partially-open states.

19 Claims, 8 Drawing Sheets

(56) References Cited

FOREIGN PATENT DOCUMENTS

| | | | | | |
|---|---|---|---|---|---|
| DE | 102013102611 | A1 | | 9/2014 | |
| DE | 102015118612 | A1 | * | 5/2017 | |
| DE | 102015118612 | A1 | | 5/2017 | |
| WO | WO-2016169925 | A1 | * | 10/2016 | ..... B67C 3/04 |
| WO | 2019228805 | A1 | | 12/2019 | |

* cited by examiner

FILLING ELEMENT, FILLING SYSTEM, AND METHOD FOR FILLING CONTAINERS

RELATED APPLICATIONS

This is the national stage under 35 USC 371 of international application PCT/EP2019/077017, filed on Oct. 7, 2019, which claims the benefit of the Nov. 6, 2018 priority date of German application DE 102018127592.7, the contents of which are incorporated herein by reference.

FIELD OF INVENTION

The invention relates to a filling element for filling containers.

BACKGROUND

When filling containers, it is known to use gas channels for a variety of purposes. These include pressurizing the container or permitting gas to escape during filling. The most common gas used for pressurizing and flushing containers is carbon dioxide.

Because liquid filling-material tends to splash, there are times when droplets reach these gas channels. These droplets can serve as a breeding ground for certain types of bacteria that thrive in a carbon-dioxide rich atmosphere. It is therefore desirable to avoid having these residues reach a container being filled.

Another disadvantage of known filling systems is that liquid can enter the container so rapidly that it is difficult to measure the fill level and send a signal to stop the filling quickly enough to prevent overshoot. To some extent, this problem can be solved by reducing the filling speed. But in that case, the container will take longer to fill.

SUMMARY

The invention provides a way to fill containers while reducing the likelihood of introducing residues into the container and promoting more accurate determination of filling height.

The filling element described and claimed herein is suitable for mass production of beverages at a rate of 5,000 to as much as 50,000 container per hour. The containers can include cans and bottles. In many embodiments, the filling material is a still beverage or a carbonated beverage. However, the invention is not limited by the nature of the filling material.

The filling element comprises a fluid channel through which the filling material can flow from a fluid tank. At least one fluid valve is arranged in the fluid channel. With the fluid valve open, the filling material is discharged into the respective container by way of a discharge opening following the fluid valve in the direction of flow of the filling material.

The filling element further comprises a gas channel with a gas valve and a gas opening. The gas channel is, in particular, a channel for a flushing gas and/or pressurizing gas and/or return gas. In some embodiments, flushing gas is conveyed into the container before the filling of the container, in order to remove the last impurities from the container, while, during pressure filling, pressurizing gas is conveyed into the container immediately before the filling of the container, such that the fluid filling material is filled into the container against the pressure of this pressurizing gas. In some embodiments, the flushing gas and the pressurizing gas can be the same gas, in particular carbon dioxide.

During the filling of fluid filling material, the return gas channel serves to convey the pressurizing gas that is displaced out of the container. The return gas is therefore, as a rule, identical to the pressurizing gas, and therefore, in particular, carbon dioxide. The conveying of flushing gas, pressurizing gas, and return gas can take place via one single gas channel. However, in some embodiments, they take place over separate gas channels. The gas valve serves to open or close the gas channel, depending on whether a gas flow is desired or not. The gas opening is configured in such a way that, during the filling of the container, it extends into a container interior of the container and/or faces towards the container.

According to the invention, the gas valve has several discrete states or settings that it can assume. These include a closed state, a fully-opened state, and a partially-open state. The flow of the gas can therefore advantageously be regulated. For example, if, with the gas valve partially opened, gas, in particular flushing gas or pressurizing gas, is conveyed through the gas valve, then the flow of the gas is diminished relative to the flow that occurs when the gas valve is in its fully open state.

Depending on the opening of the gas valve and the resulting flow, this leads to one of the following effects: A substantially reduced flow is too weak to carry with it the fluid residue adhering to the gas channel. But at the same time, this reduced flow contributes to rapid drying of the residue adhering to the gas channel. During the drying, therefore, only gas with a higher gas humidity emerges from the gas channel. With greater flow, filling material can be carried away, but not enough energy is available to atomize it to a significant extent.

There are a number of different possibilities for freeing the gas channel from the filling material residues adhering to it. Explained here in detail, for example, is the case in which the filling material residue adhering to the gas channel is carried along but not atomized.

In some embodiments, the gas emerging from the gas channel, and the filling material residue carried with it, are conveyed into an empty container that is still to be filled. This can take place before or at the beginning of the flushing and/or pressurizing of the container. Since the filling material residues are not atomized, far less filling material is carried into the container than would have been carried under higher gas flow. This results in a lower population of bacteria that thrive in a carbon-dioxide rich atmosphere. This also inhibits excessive foam formation.

It is further possible for the gas emerging from the gas channel and the filling material residue carried with it to be conveyed into an already filled container.

Finally, the gas with the filling material residues can then be conveyed out of the gas channel if there is no container present at the filling element. This is the case, for example, if the filling element is arranged at a transport element and is located in the direction of rotation of the transport element between an outlet star and an inlet star of a filling system. In this region, the filled container has already left the filling element, and the next container to be filled has not yet been brought to the filling element. Due to the fact that there is no container present at the filling element, the discharge of the gas with the filling material residues in this region has no negative effects on the container. Due to the filling material residues not being atomized, they can also be caught in an adjacent region, while, conversely, atomized filling material residues discharged in this way would threaten causing a contamination of the entire filling system.

The reduction of the flow speed of the gas in the gas channel therefore offers a range of possibilities for freeing the gas channel of filling material residues and avoiding difficulties that arise from the presence of bacteria that thrive in carbon dioxide, e.g., methanogens.

In some embodiments, it is advantageous, when filling the container with the liquid filling material, to convey the pressurizing gas out of the container via the gas channel with the gas valve being in its partially-opened state. This reduces the flow speed of the returning gas relative to what it would have been had the gas valve been in its fully-opened state. This also reduces how quickly the container is filled. As a result, it becomes easier to attain a desired filling quantity or filling height respectively in the container.

In some embodiments, the gas valve is configured in such a way that it has more than one partially-open state. This results in two partially-open states with different flow resistances.

In some embodiments, the gas valve comprises a combination of a valve needle and a wall of the gas channel. The valve needle has regions with different diameters so that the outer wall of the gas channel has a region with a reduced inner diameter. As a result of a height movement of the valve needle relative to the outer wall of the gas channel, the regions of the valve needle having different outer diameters are brought into operational connection with the reduced inner diameter. This results in the position of the needle being used to select flow cross-sections of different sizes.

During the individual method steps of filling of the container, it is possible to choose the state that has the most appropriate flow resistance. For example, for the slow drying of the gas channel of filling material residues, a greater flow resistance is required than for the slow filling of the container with the fluid filling material. Having more than one partially-open state means the gas valve has more flexibility in choosing flow resistance.

In some embodiments, the gas channel is configured to have a hollow probe near the gas opening. The hollow probe measures the container's filling height and determines the maximum filling height of the container. This avoids the need for a separate device for measuring or determining the container's filling height.

In some embodiments, the gas valve comprises a valve tube with a seal seat and a valve needle with a sealing surface. The valve needle moves in relation to the valve tube. In the gas valve's closed-state, the sealing surface contacts the seal seat and thereby closes the gas valve. In the gas valve's fully-open state, the sealing surface is removed from the seal seat, thus creating a region through which gas is free to flow. A gas valve a valve tube and valve needle can therefore be controlled in a particularly simple manner. This permits the gas valve to delimit the gas flow precisely. Such a gas valve is also robust and expected to have long service life.

It is advantageous if, in the closing direction, the valve needle comprises a choke element arranged behind the sealing surface, and the valve tube comprises a narrow point arranged in a region arranged behind the seal seat in the closure direction, wherein, in particular, a diameter of the choke element is smaller than a diameter of the narrow point. There is then a gap formed between the choke element and the narrow point, in particular a ring gap, through which the gas can flow when the gas valve is at least partially opened. Depending on which diameter the choke element and the narrow point exhibit, a wider or narrower ring gap is thereby produced, and consequently a lower or greater flow resistance. With the aid of the choke element and a correspondingly shaped valve tube, it is therefore possible for different flow resistances, and therefore different switch statuses of the gas valve, to be easily put into effect.

In a particularly advantageous embodiment, a shaft is arranged between the sealing surface of the valve needle and the choke element, which has a diameter which is smaller than the diameter of the choke element, and the valve tube has, in the closing direction, behind the narrow point, a slot, in particular ring-shaped or lateral. If the valve needle moves from the closed switch status, against the closing direction, then it can move into a position in which the shaft is located in the region of the narrow point, and the choke element is located in the region of the slot, as a result of which a relatively wide gap is rendered free. With further movement of the valve needle against the closing direction, the choke element comes into the region of the narrow point, as a result of which the freed gap is relatively narrow, and a correspondingly high flow resistance is incurred. Finally, the valve needle can be moved still further against the closing direction, such that the choke element, in the closing direction, is located in front of the seal seat, and renders free a very wide gap, with a correspondingly low flow resistance. With the gas valve of this embodiment, it is therefore possible for different switch statuses of the gas valve to be established and switched very easily.

Further proposed is a filling system, in particular a filling machine, of circulating type. Such a filling system is used, for example, as a container handling machine in the beverage industry. The filling system comprises a plurality of filling elements at a transport element, for example at a circulating rotor. In one embodiment, the filling system takes over containers, which, for example, have been produced and/or cleaned by further container treatment machines, at an inlet star, and transports them onwards with the transport element. In this situation, assigned to each container is a filling element, arranged at the transport element, which fills the container. The filled containers are therefore discharged at an outlet star, and again conveyed to a further container treatment machine, which, for example, then closes the containers.

According to the invention, the filling elements are configured in accordance with the preceding description, and they therefore comprise, in particular, a gas channel with a gas valve, which exhibits a closed switch status, an open switch status, and a partially open switch status. By means of the partially open switch status, the flow speed of the gas in the gas channel can be reduced to such an extent that fluid material residues adhering to the gas channel can either be dried or pushed gently out of the gas channel. If, in addition to this, the gas channel is used to discharge the pressurizing gas at the filling of the containers, the flow speed of the pressurizing gas, and therefore the filling speed of the container can be reduced in such a way that a precise attainment of a desired filling quantity or filling height in the container is made easier. Further advantages are derived from the preceding description.

Also proposed is a method for the filling of containers with a fluid filling material, provided from a filling material tank, by means of a filling element. Such a method can comprise the flushing of the container with flushing gas, in particular carbon dioxide. In this situation, the flushing gas is introduced via a gas channel into the container, and then extracted again by suction by way of a negative pressure device. The introducing and extracting of the gas can take place in this situation simultaneously or one after another. As an alternative or in addition to the flushing, the method can comprise a pressurizing of the container with pressurizing gas, in particular likewise carbon dioxide. In this situation, the pressurizing gas is introduced via a gas channel under increased pressure into the container, such that a positive pressure is built up in the container, against which the fluid filling material can then be filled.

For the flushing and/or pressurizing of the container, in this situation the gas valve of a gas channel of the filling element is opened, such that the flushing gas or pressurizing gas is conducted via the gas channel and a gas opening into the container. For the subsequent filling of the container, a fluid valve of a fluid channel of the filling element is opened, such that the fluid filling material flows out of the fluid material tank, via the fluid channel and a discharge opening into the container. Particularly advantageously, the fluid valve opens automatically as soon as pressure compensation has been reached between the filling material tank and the container which is to be filled.

According to the invention, the method is carried out by means of a filling element according to the preceding description. Furthermore, the gas channel is dried, inasmuch as the gas valve is at least at intervals of time partially opened, and the flushing gas or pressurizing gas flows through the gas channel, such that filling material residues present in the gas channel are dried, at a flow speed of the flushing gas or pressurizing gas which is reduced in comparison with a completely opened gas valve, and/or are expelled from the gas channel. If the flow speed of the flushing gas or pressurizing gas is low enough, the filling material residues are then not carried with the flushing gas or pressurizing gas and are simply dried by the gas flowing past. At a somewhat greater flow speed, but which is still less than the flow speed with the gas valve completely opened, the filling material residues are carried with the flushing gas or pressurizing gas, but at the gas opening are gently expelled from the gas channel, and, in particular, are not atomized. The problem of the atomized filling material residues is therefore avoided, in particular that they form carbon dioxide evolving bacteria in the container.

Advantageously, at the drying of the gas channel, the gas valve is first partially opened, and, after a predetermined period of time, is opened further, in particular completely. With the partially opened gas valve, a large part of the filling material residues in the gas channel is dried, as described heretofore. The complete opening of the gas valve now speeds up the drying of the few remaining filling material residues. These are indeed now carried along with the flushing gas or pressurizing gas, and atomize at emergence from the gas channel, but, due to the small quantity of the filling material residues still remaining, this leads to only a small number of carbon dioxide evolving bacteria being formed.

It is of advantage if the drying of the gas channel is carried out after the ending of the filling of the container, wherein the gas opening is still located in the container or directly above the container. The gas emerging from the gas opening is therefore conveyed into the container, and any filling material residues which may have been carried with it but not atomized, also pass into the container, where they have no negative effects on the filling material present in the container.

Advantageously, the drying of the gas channel is carried out when there is no container located at the filling element, in particular if the filling element is located in the direction of rotation of a transport element at which the filling element is arranged, between an outlet star and an inlet star of a filling system comprising the filling element. With this embodiment, the container is not influenced at all by the drying of the gas channel. Expelled filling material residues can additionally be easily caught, since they are not atomized at the emergence from the gas channel, with the result that no contamination of the filling system with filling material residues occurs.

In a particularly advantageous embodiment, the drying of the gas channel takes place immediately before the flushing and/or pressurizing of the container, or represents a first part step of the flushing and/or pressurizing of the container. Since use is advantageously made of the flushing gas or pressurizing gas for the drying of the gas channel, the method steps which require flushing gas or pressurizing gas are combined. If, moreover, the drying of the gas channel also already represents a part step of the flushing and/or pressurizing of the container, the loss of time incurred for the drying is kept particularly short.

Finally, a further method is proposed for the filling of containers with a fluid filling material, provided from a filling material tank, by means of a filling element. In this situation, the container is pressurized by a pressurizing gas, and, for the filling of the container, a fluid valve of a fluid channel of the filling element is opened, such that the fluid filling material flows out of the filling material tank, via the fluid channel and a discharge opening, into the container. Moreover, a gas valve of a gas channel of the filling element is opened, such that the pressurizing gas displaced by the fluid filling material can emerge out of the container via the gas channel.

According to the invention, the method is carried out by means of a filling element according to the preceding description. Moreover, at the filling of the container, the gas valve is at least at intervals of time only partially opened, such that the flow speed of the pressurizing gas, and therefore the filling speed of the fluid filling material, is reduced in comparison with a fully opened gas valve. Due to the reduced filling speed of the fluid filling material, the point of time at which the desired filling quantity or filling height will be or is reached, can be determined more precisely and more easily, and therefore also the point of time at which the fluid valve is closed, and therefore the filling ended, can be set more precisely and more easily.

Advantageously, at the filling of the container, the gas valve is first opened wide, in particular completely, and, after a predetermined time or at the attaining of a determined filling height or filling quantity of the container, is still only partially opened. Accordingly, in the first instance the filling of the container can be carried out at a high, or maximum, filling speed, which has a positive effect on the time necessary for the filling. The reduced filling speed of the fluid filling material is only required at the end of the filling of the container, such that the gas valve is also only partially opened at the end of the filling of the container. In this situation, exactly when the filling speed is to be reduced can be determined by a predetermined filling time which has already elapsed, or by the attaining of a specific filling height or filling quantity. The rapid filling of the container is therefore followed by the phase which is slower but more precise for this purpose.

It is also of advantage if the gas channel is dried, in that the gas valve is, at least at intervals of time, partially opened, and flushing gas or pressurizing gas flows through the gas channel, such that filling material residues present in the gas channel are dried and/or expelled from the gas channel at a flow speed of the flushing gas or pressurizing gas which is reduced in comparison with a completely opened gas valve. This is particularly advantageous if a common gas channel is being used, and therefore a common gas valve for the flushing gas, pressurizing gas and return gas. The gas valve can therefore provide both a reduced flow speed for the drying of the gas channel, as well as a reduced filling speed for the filling of the container, in each case with the advantages referred to heretofore.

Further embodiments, advantages, and possible applications of the invention are also derived from the following description of exemplary embodiments and from the Figures. In this context, all the features described and/or represented as pictorial images are in principle the object of the invention, alone or in any desired combination, regardless of their connection in the claims or reference to them. The contents of the claims are also deemed to be a constituent part of the description.

BRIEF DESCRIPTION OF THE FIGURES

These and other features of the invention will be apparent from the following detailed description and the accompanying figures, in which.

Figure 1A:
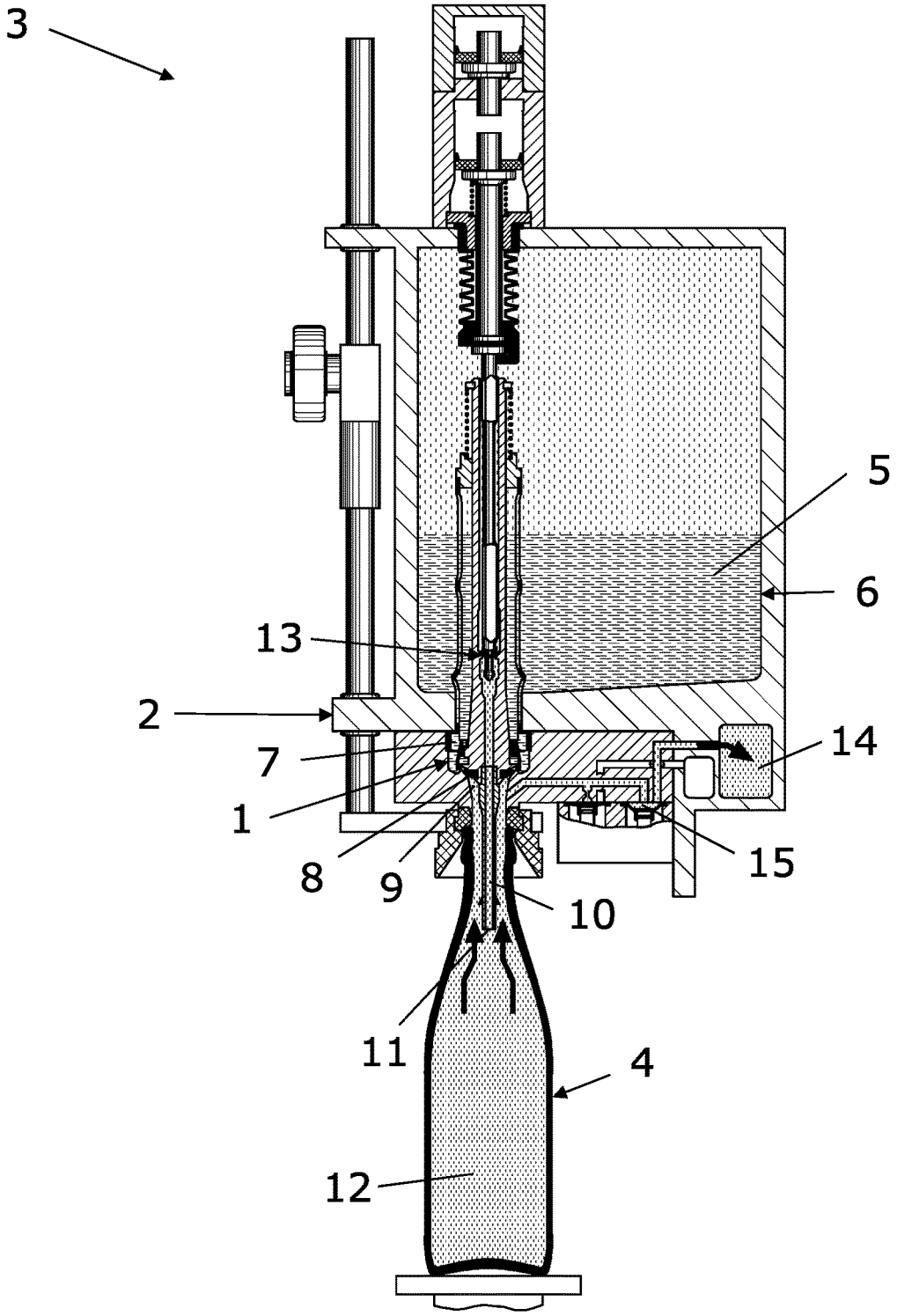
FIGS. 1*a*-1*e* show longitudinal sections through a filling element.

Identical reference numbers are used in the Figures for elements of the invention which are the same or have the same effect. Moreover, for the sake of easier overview, only those reference numbers are represented in the individual FIGS. which are necessary for the description of the respective Figure.

DETAILED DESCRIPTION

FIGS. 1*a*-1*e* show longitudinal sections through a filling element 1 at different stages of a filling process. The filling element 1 is arranged at a transport element 2 of a filling system 3, of which only a section is shown here.

The filling element 1 is connected, preferably for the duration of the filling process, to the container 4 that is intended to be filled with a fluid filling material 5, which is provided from a tank 6. The fluid filling material 5 encompasses any type of liquid that can be filled into containers 4. However, the illustrated filling element 1 and the filling method are particularly useful for filling containers 4 with beverages, predominantly beverages that have been carbonated with carbon dioxide. Although the container 4 is shown as a bottle, the filling element 1 and the associated filling process are also well-suited, with slight, for other containers, such as cans or beakers.

The liquid channel 7 connects to the tank 6 and ends in a discharge opening 9. The discharge opening 9 faces the container 4. A liquid valve 8 along the liquid channel 7 opens to allow filling material 5 to enter the container 4.

The gas channel 10 conveys gases that have served a variety of functions, such as a flushing gas, a pressurizing gas, and return gas that is displaced from the container 4 during filling thereof. Some embodiments feature plural gas channels 10, each of which carries a different gas.

The gas channel 10 comprises a gas opening 11. In the illustrated embodiment, the gas opening 11 extends into the container's interior 12. In other embodiments, the gas opening 11 does not extend into the container 4 but nevertheless faces it so that gas can enter the container 4.

A gas valve 13 along the gas channel 10 switches between the states of being opened, being closed, and being partially open. In some embodiments, there are multiple partially-open states. A particular embodiment has three partially-open states. These different partially-open states offer different flow resistances, which are optimized for various stages of filling.

The filling process begins with the transport element 2 receiving the container 4 from an inlet star and connecting it to the filling element 1. In some filling processes, the container 4 is sealed tightly against the filling element. However, other filling processes do not require a tight seal.

As shown in FIG. 1*a*, the filling process continues with the liquid valve 8 and the gas valve 13 both being closed. The container 4 is then exposed to a vacuum 14, thereby removing any residual gas in the container 4.

Figure 1B:
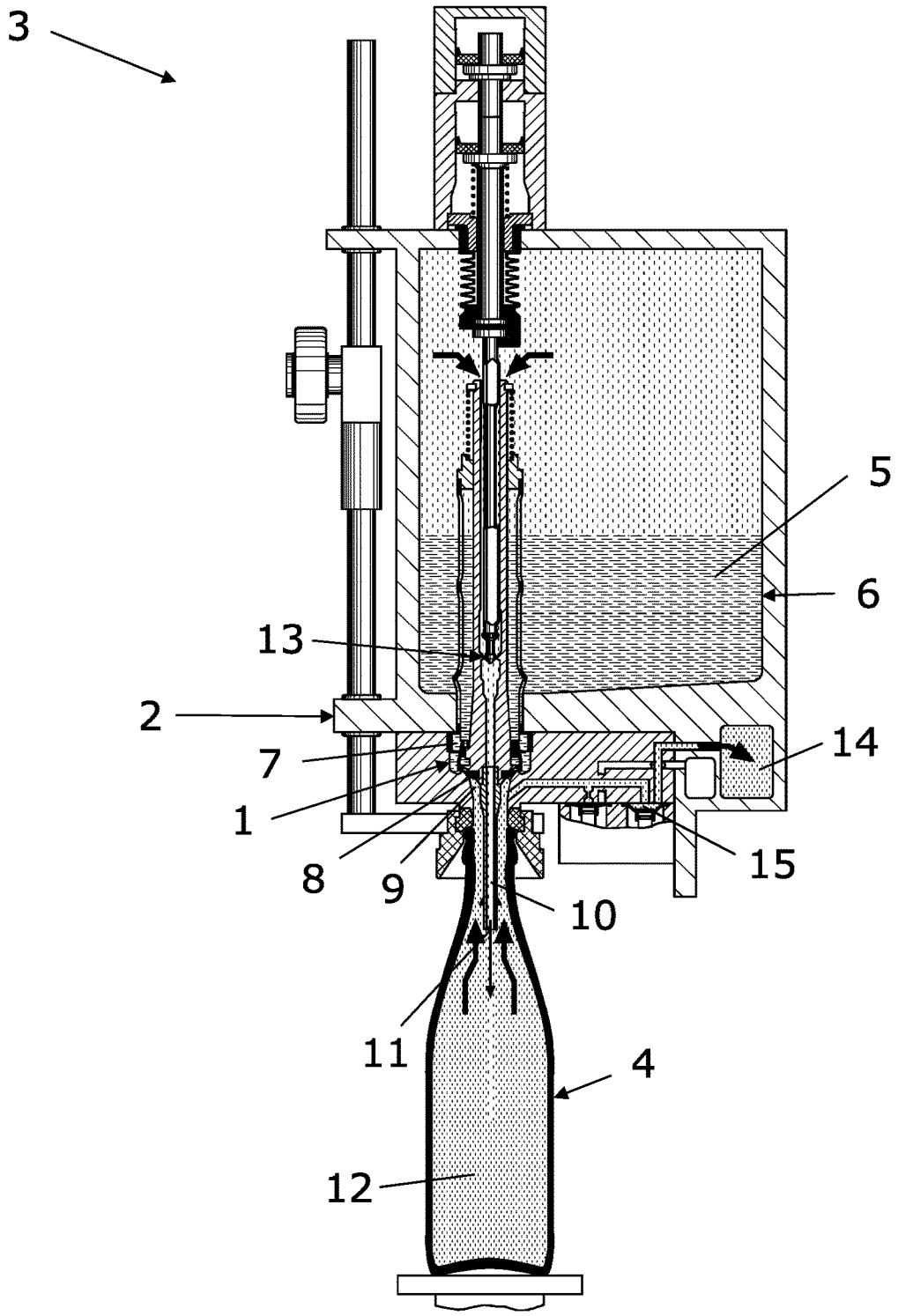

FIG. 1*b* shows a flushing step that includes partially opening the gas valve 13. This permits a flushing gas, which is typically carbon dioxide, to dry any filling material residue still present in the gas channel 10. The vacuum 14 is then used to suck any flushing gas flowing into the container 4.

atomized It is also possible to further open the gas valve 13. This causes flushing gas to carry any filling-material residues present in the gas channel 10. Some of these residues may be carried into the container 4 through the gas opening 11. However, because the gas valve 13 partially chokes the flow of flushing gas, these residues move slowly enough to avoid atomization. This is useful to prevent introduction, into the container 4, of certain types of bacteria that thrive in carbon dioxide.

Figure 1C:
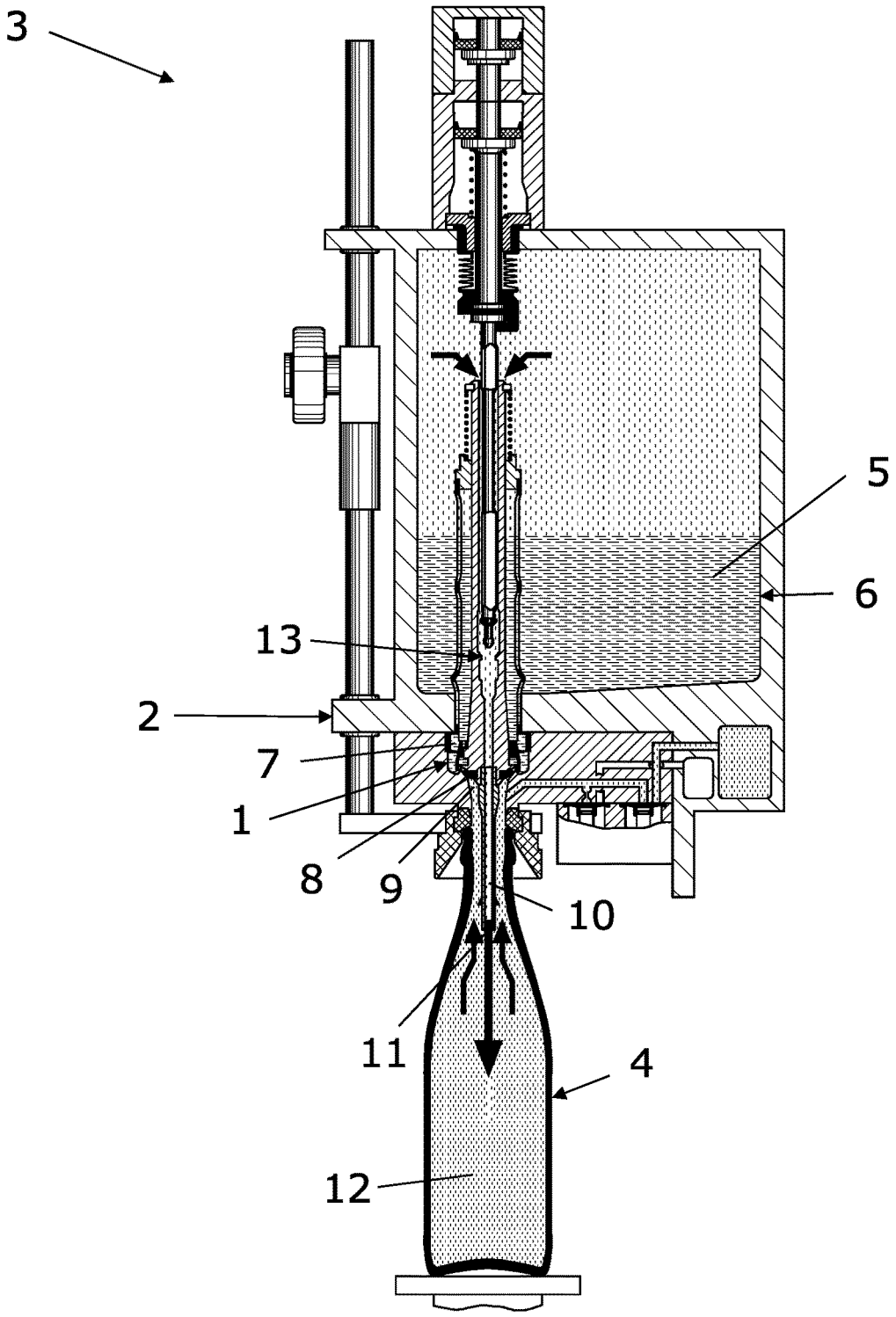

FIG. 1*c* shows the next step, which is to pressurize the container 4 with a pressurizing gas, such as carbon dioxide. This is carried out by fully opening the gas valve 13. To prevent this pressurizing gas from being sucked out of the container 4, it is useful to also close a vacuum valve 15, thus disconnecting the vacuum source 14. As a result, pressure builds within the container 4.

In this case, it is possible to fully open the gas channel 10 because all filling-material residues will have already been removed during the preceding flushing step. On the other hand, if the pressurizing gas is to be introduced using a channel that differs from that used for flushing, the gas valve 13 should only be partially opened. This avoids the risk of introducing filling-material residues that may carry bacteria of the type that thrive in carbon dioxide.

Figure 1D:
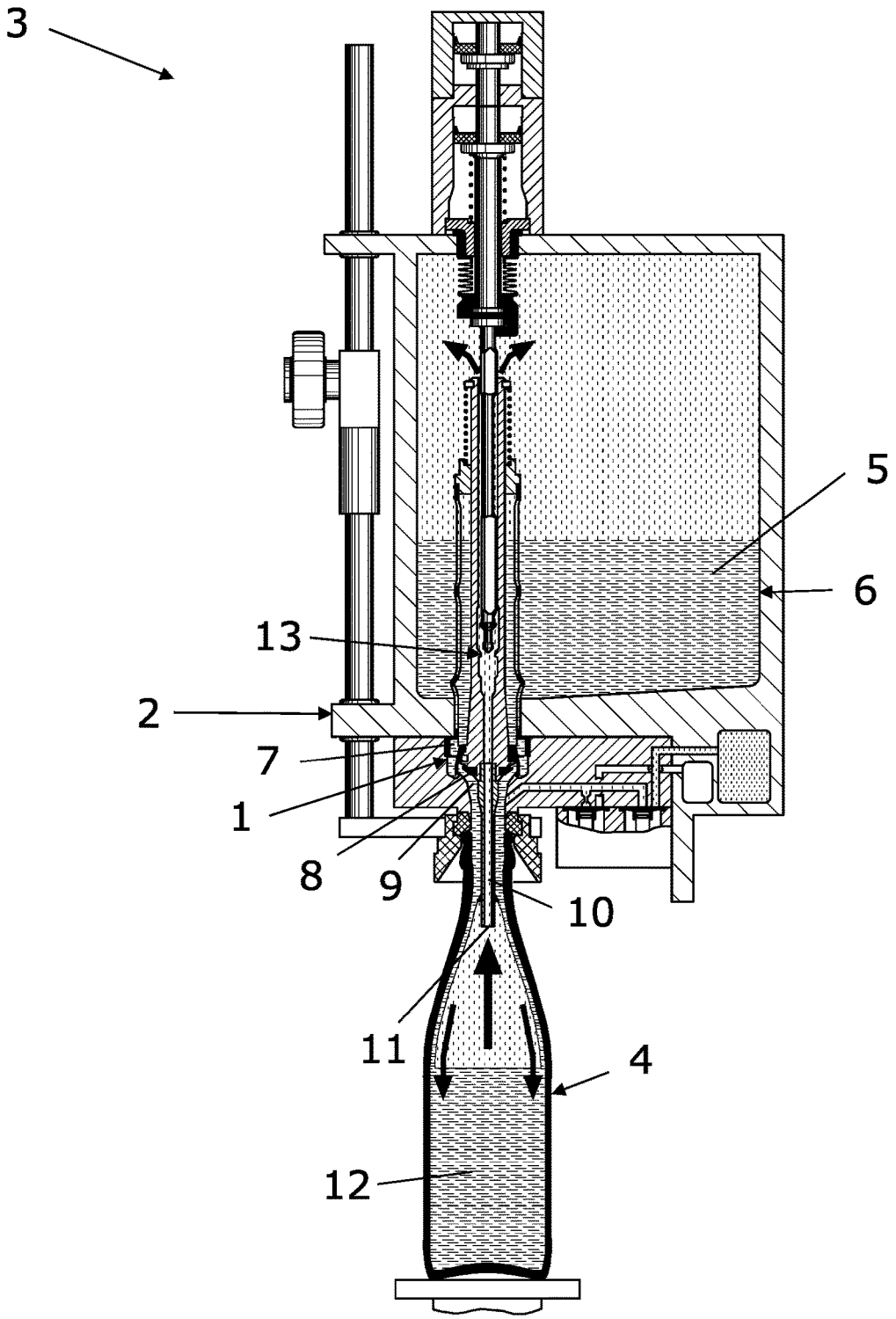
Figure 1E:
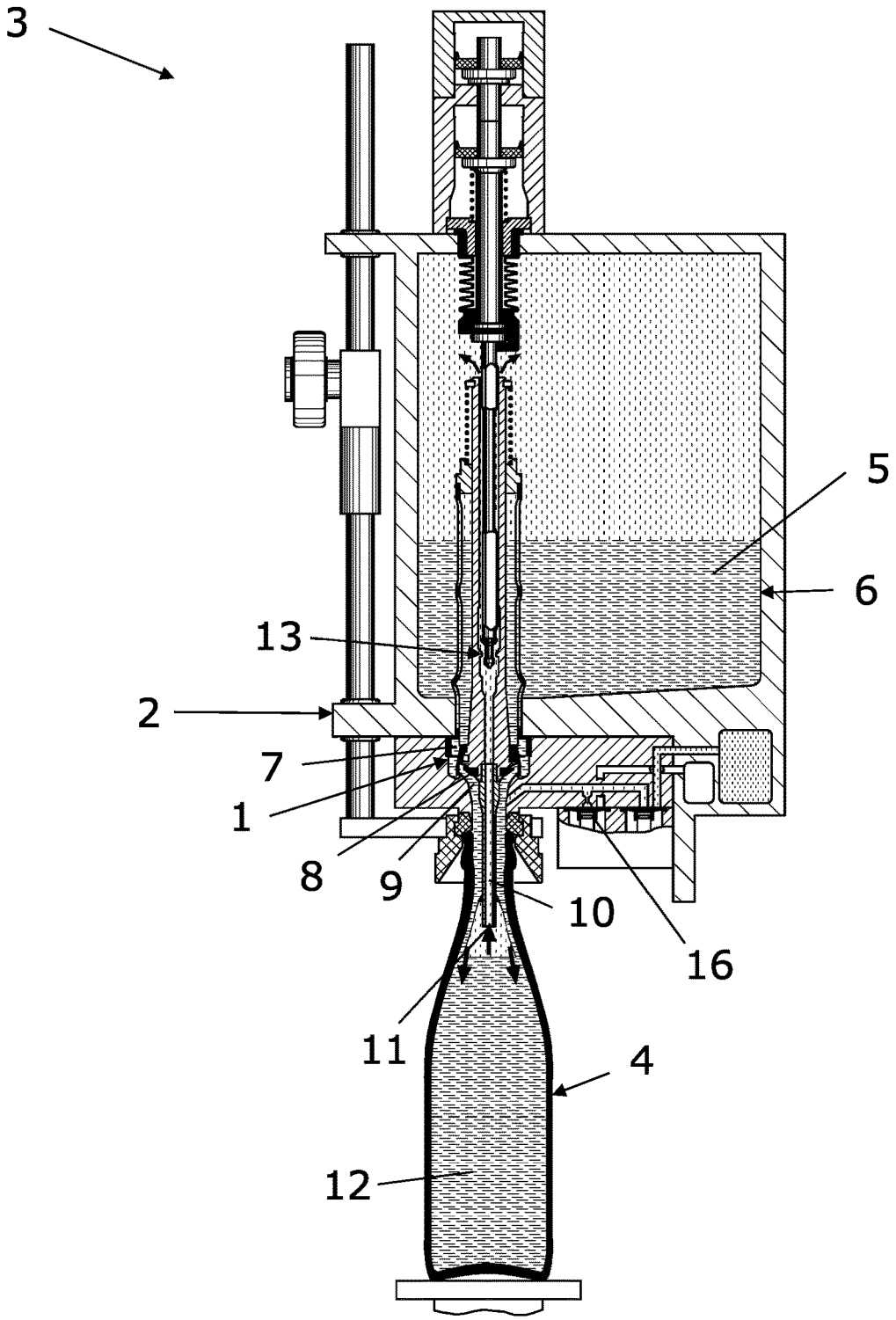

The next step is to introduce the actual liquid filling-material, as shown in FIG. 1*d*. The liquid filling-material is introduced against the pressure of the pressurizing gas. In this step, the gas channel 10 plays the role of a return gas channel that can convey return gas as the filling material displaces it from the container. In this step, the liquid valve 8 is opened and the gas valve 13 is, at first, almost completely opened. This permits rapid outflow of the pressurizing gas from the container and thus rapid inflow of liquid filling-material into the container 4.

Due to the slower inflowing filling material 5 it is easier for the desired filling height or filling quantity to be attained in the container 4. The next step is to slow down the filling as the desired filling height is reached. This provides a sensor that senses the filling height with enough time to make an accurate measurement and send an appropriate signal to stop filling. This deceleration step includes closing or choking the gas valve 13, thus reducing the rate at which return gas leaves the container. This slows down the rate at which filling material can enter.

A variety of ways are used to measure the filling height. These include an optical sensor or a hollow probe near the gas opening 11. An alternative method is to use the Trinox process, in which a container continues to be filled until the liquid filling-material 5 reaches the gas opening 11. When this happens, the gas opening 11 becomes submerged. As a result, no more return gas can escape. This halts the filling process. A sensor in the gas channel 10 recognizes the rising filling material 5 and determines that the filling height has been reached.

Upon reaching the desired filling height, the liquid valve 8 closes and the gas valve 13 also closes. A pressure-equalization valve 16 relieves pressure in the container 4.

When filling is complete, the container 4 is separated from the filling element and transferred to an outlet star for transport to a subsequent container-treatment machine.

FIGS. 2*a*-2*e* show the gas valve 13 in stages corresponding to those in FIGS. 1*a*-1*e*.

Figure 2A:
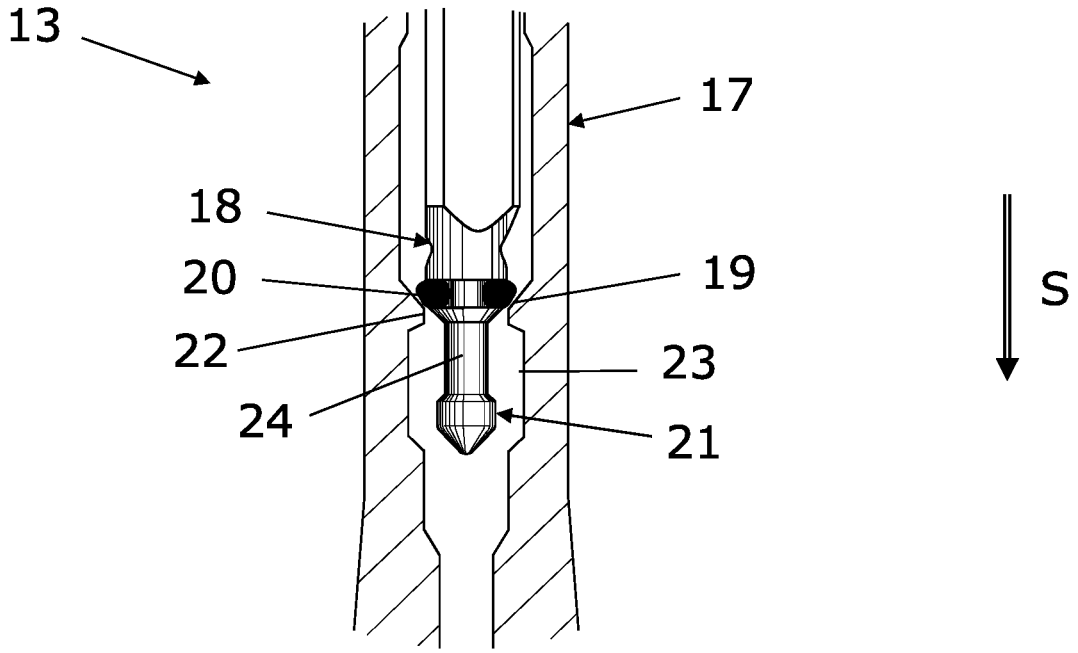
FIGS. 2*a*-2*e* show longitudinal sections through the gas valve of FIGS. 1*a*-1*e* at various stages of filling.

In FIG. 2*a*, the gas valve 13 is shown in its closed position. The gas valve 13 includes a gas-valve tube 17 with a seal seat 19. A gas-valve needle 18, which moves relative to the gas-valve tube 17, has a sealing surface 20 and a choke 21 separated by a shaft 24. As the gas-valve needle 18 moves distally towards the container 4 along a closing direction S, the seal seat 19 eventually engages the sealing surface 20 and closes the gas valve 13.

Figure 2B:
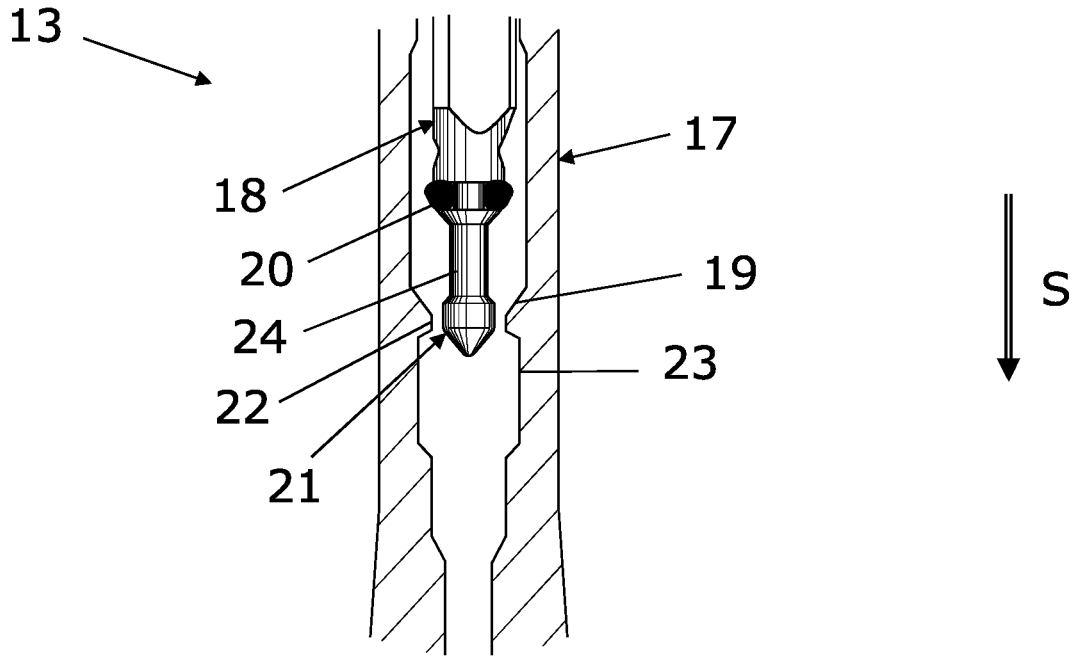

Moving the valve needle 18 proximally, in the direction opposite the closing direction S, causes the gas valve 13 to assume a partially-open position, as shown in FIG. 2*b*. This causes the choke 21 to be within a constriction 22 of the gas-valve tube 17, which is proximal to the seal seat 19. As a result, only a narrow annular gap remains between the choke 21 and the wall of the gas-valve tube 18 at the constriction 22.

Figure 2C:
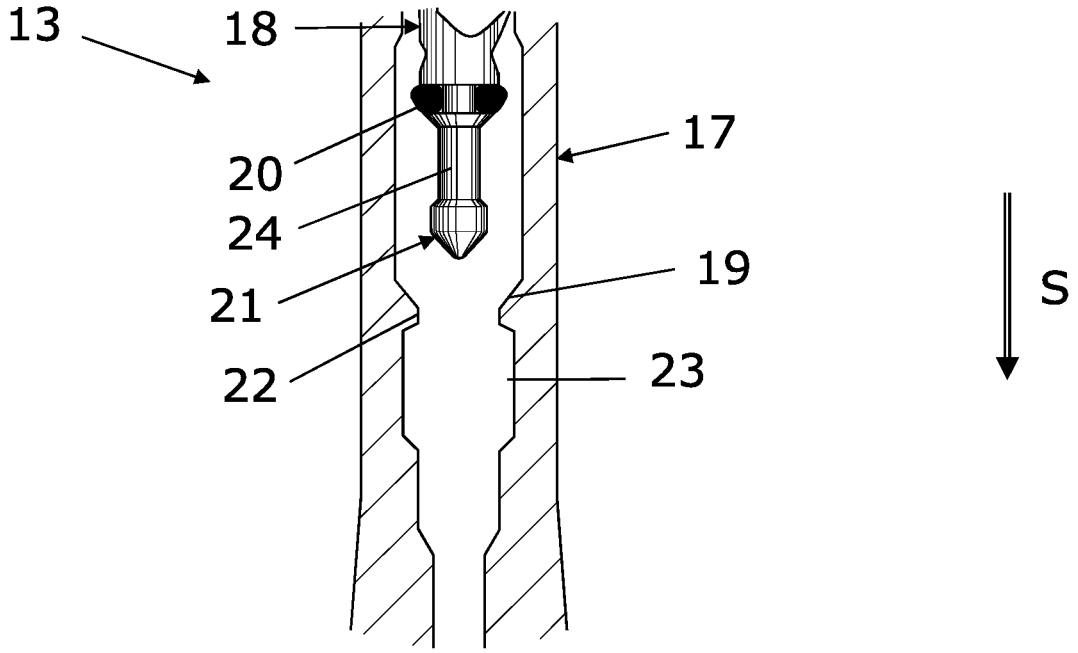

Moving the choke 21 further proximally, against the closing direction S, raises it out of the constriction 22 and completely opens the gas valve 13, as shown in FIG. 2*c*.

Figure 2D:
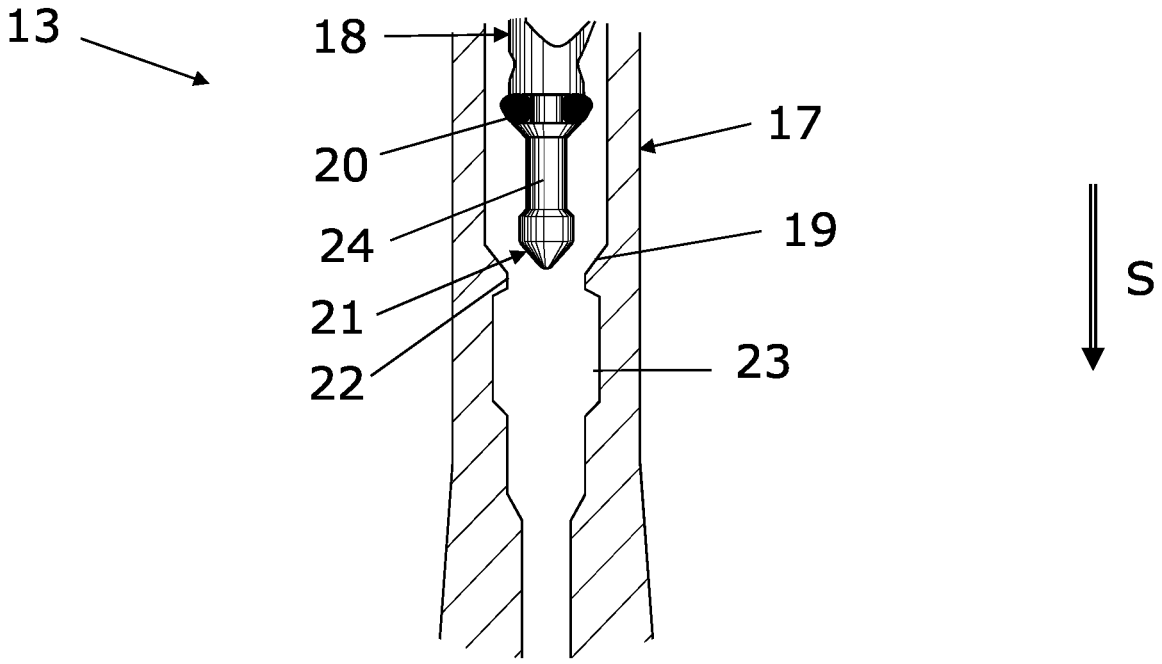
Figure 2E:
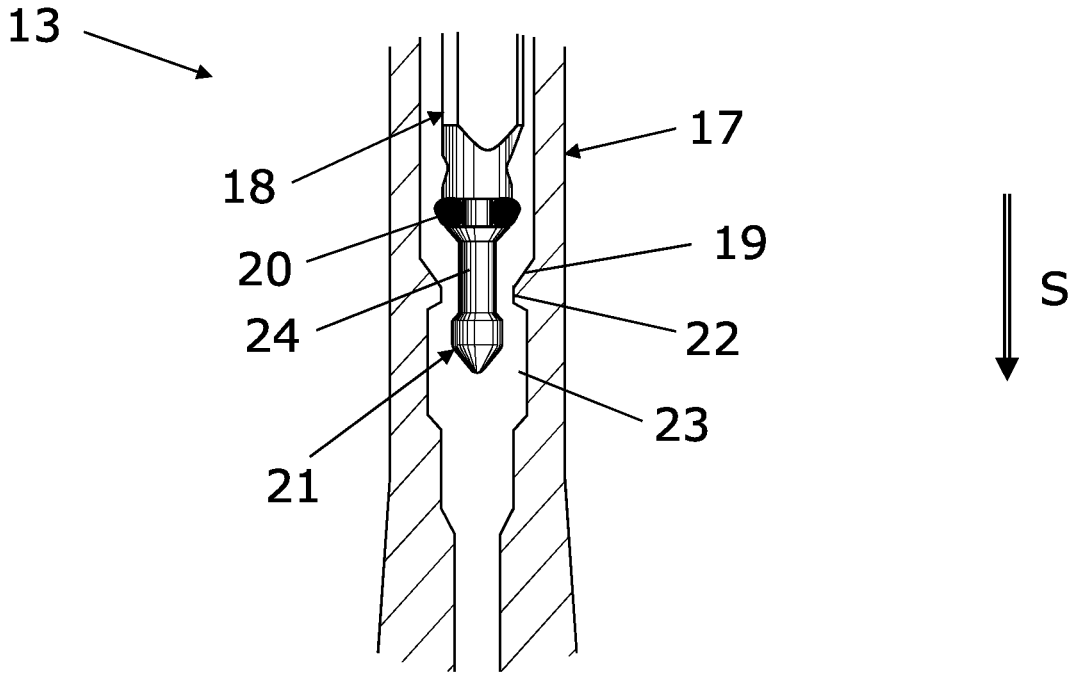

Moving the valve needle 18 distally by a small amount in the closing direction S, as shown in FIG. 2*d*, leaves the gas valve 13 almost completely open, However, with the choke 21 now being closer to the seal seat 19, flow resistance will have changed. A flow resistance that is between that arising at FIGS. 2*b* and 2*d* can be achieved by moving the valve needle 18 further in the closing direction S as shown in FIG. 2*e*. In this position, the choke 21 has moved past the seal seat 19 and the constriction 22 to a region at which the gas-valve tube 17 widens to form a slot 23.

In the position shown, the slot 23 is an annular region that surrounds the choke 21. The shaft 24, meanwhile, lies in the construction 22. Since the shaft's diameter is smaller than that of the choke 21, the flow resistance that arises from having the shaft 24 at the constriction 22 is somewhat less than it would have been had the choke 21 been at the constriction 22 instead. This results in a medium flow resistance.

Figure 3:
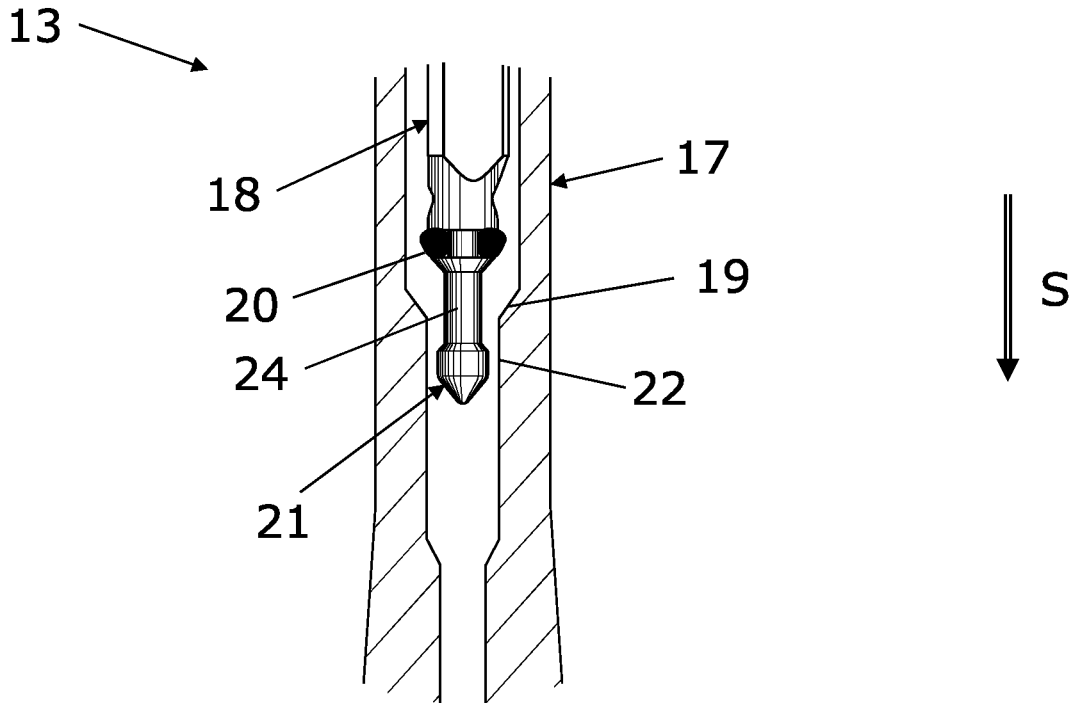
FIG. 3 shows a longitudinal section through a further embodiment of a gas valve for use in the filling element of FIGS. 1*a*-1*e*.

FIG. 3 shown an alternative gas valve 13 that lacks the slot 23. As a result, the gas valve 13 has more difficult attaining a medium flow resistance as shown in FIG. 2*e*. However, the gas valve 13 shown in FIG. 3 is simpler and more economical to produce, while still retaining a partially-open state.

The invention has been described heretofore by way of exemplary embodiments. It is understood that a large number of modifications or derivations are possible, without thereby departing from the scope of protection of the invention defined by the claims.

The invention claimed is:

1. An apparatus for filling containers with a filling material, said apparatus comprising a filling element, said filling element comprising a fluid channel through which liquid filling-material provided by a filling-material tank flows, a liquid valve in said fluid channel, a discharge opening downstream of said liquid valve for discharging said filling material into a container with said liquid valve opened, a gas channel having a gas opening through which gas flows into said container, and a gas valve that controls flow of gas through said gas channel, wherein said gas opening either extends into or faces said container during filling thereof and wherein said gas valve is configured to transition between a plurality of discrete states, said states comprising a fully-open state, a closed state, and at least one partially-open state, said fully-open state and said partially-open state having different flow resistances, wherein said gas valve includes a gas-valve tube with a seal seat and a gas-valve needle that moves relative to said gas-valve tube, said gas-valve needle comprising a sealing surface and a choke separated by a shaft, wherein, as said gas-valve needle moves distally towards said container along a closing direction, said seal seat eventually engages said sealing surface and closes said gas valve wherein proximal movement of said valve needle in a direction opposite said closing direction, causes said gas valve to assume a partially-open position in which said choke is within a constriction of said gas-valve tube, thereby causing only a narrow annular gap to remain between said choke and a wall of said gas-valve tube at said constriction, wherein further proximal movement of said choke raises said choke out of said constriction and completely opens said gas valve.

2. The apparatus of claim 1, wherein said states comprise first and second partially-open states that have different flow resistances.

3. The apparatus of claim 1, wherein said gas valve comprises a gas-valve tube and a gas-valve needle that moves relative to said gas-valve tube along a closing direction to transition from said fully-open state to said closed state, wherein said gas-valve tube comprise a seal seat and said gas-valve needle comprises a sealing surface, wherein, in said closed state, said sealing surface lies on said seal seat to close said gas valve, and wherein, in said fully-open state, said sealing surface is at a distance from said seal seat, thereby permitting flow through said gas valve.

4. The apparatus of claim 1, wherein said gas valve comprises a gas-valve tube comprising a seal seat and a constriction distal to said seal seat, said constriction having a constriction diameter and a gas-valve needle that moves distally relative to said gas-valve tube along a closing direction when transitioning to said closed state, wherein said gas-valve needle comprises a sealing surface and a choke distal to said sealing surface, said choke having a choke diameter that is smaller than said constriction diameter, thereby permitting said choke to pass through said constriction during distal movement of said gas-valve needle.

5. The apparatus of claim 1, wherein said gas valve comprises a gas-valve tube and a gas-valve needle that moves distally relative to said gas-valve tube along a closing direction when transitioning to said closed state, wherein said gas-valve tube comprises a seal seat, a constriction distal to said seal seat, and a slot distal to said constriction, said slot being one of annular and lateral, and wherein said gas-valve needle comprises a sealing surface, a choke distal to said sealing surface, and a shaft that extends between said choke and said sealing surface, said choke having a choke diameter that is less than a diameter of said constriction, thereby permitting said choke to pass through said constriction during distal movement of said gas-valve tube.

6. A method for using a filling element that comprises comprising a fluid channel through which liquid filling-material provided by a filling-material tank flows, a liquid valve in said fluid channel, a discharge opening downstream of said liquid valve for discharging said filling material into a container with said liquid valve opened, a gas channel having a gas opening through which gas flows into said container, and a gas valve that controls flow of gas through said gas channel, wherein said gas opening either extends into or faces said container during filling thereof and wherein said gas valve is configured to transition between a plurality of discrete states, said states comprising a fully-open state, a closed state, and at least one partially-open state, said method comprising causing said gas valve to be in said partially-open state to dry filling-material residues in said gas channel of said filling element, said method further comprising filling said container with liquid filing-material drawn from said filling-material tank, whereby gas flows through said gas channel at a speed that is slower than a speed that results when said gas valve is in said fully-open state, said fully-open state and said partially-open state having different flow resistances.

7. A method for using a filling element that comprises comprising a fluid channel through which liquid filling-material provided by a filling-material tank flows, a liquid valve in said fluid channel, a discharge opening downstream of said liquid valve for discharging said filling material into a container with said liquid valve opened, a gas channel having a gas opening through which gas flows into said container, and a gas valve that controls flow of gas through said gas channel, wherein said gas opening either extends into or faces said container during filling thereof and wherein said gas valve is configured to transition between a plurality of discrete states, said states comprising a fully-open state, a closed state, and at least one partially-open state, said method comprising pressurizing said container with a pressurizing gas, opening said liquid valve, and opening said gas valve, whereby said filling material drawn from said filling-material tank and flowing via said gas channel through said discharge opening and into said container displaces pressurizing gas that is in said container through said gas channel, wherein, while said container is being filled with said filling material, causing said gas valve to transition into said partially-open state for at least a portion of time during which filling with said filling material takes place, whereby inflow speed of said filling material is lower than it would have been had said gas valve been in said fully-open state.

8. The apparatus of claim 1, wherein said states comprise first, second, and third partially-open states that have different flow resistances.

9. The apparatus of claim 1, wherein said gas valve is configured to transition into said partially-open state after said container has been filled and while said gas opening is still located in said container.

10. The apparatus of claim 1, wherein said gas valve is configured to transition into said partially-open state while no container is sealed at said filling element.

11. The apparatus of claim 1 wherein said gas valve is configured to transition into said partially-open state immediately before flushing said container.

12. The apparatus of claim 1 wherein said gas valve is configured to transition into said partially-open state immediately before pressurizing said container.

13. The apparatus of claim 1, wherein said gas valve is configured to transition into said partially-open state as a first step of flushing said container.

14. The apparatus of claim 1, wherein said gas valve is configured to transition into said partially-open state as a first step of pressurizing said container.

15. The apparatus of claim 1, wherein causing said gas valve is configured to transition into said partially-open state and to transition into said fully open state following lapse of a pre-determined time interval after said transition into said partially-open state.

16. The apparatus of claim 1, wherein said gas valve is configured to transition into said partially-open state to dry residues in said gas channel prior to filling said container from said filling-material tank.

17. The apparatus of claim 1, wherein said gas valve is configured to partially choke flow of flushing gas sufficiently to avoid atomization of residues in said gas channel.

18. The apparatus of claim 1, wherein said gas valve is configured to be in said partially-open state while said filling element fills said container, whereby inflow speed of said filling material is lower than it would have been had said gas valve been in said fully-open state.

19. The apparatus of claim 1, wherein said gas valve is configured to transition into said partially-open state after said container has been filled and while said gas opening is directly above said container.

* * * * *